US008511291B2

(12) United States Patent
Hirano et al.

(10) Patent No.: US 8,511,291 B2
(45) Date of Patent: Aug. 20, 2013

(54) POSITIVE CRANKCASE VENTILATION SYSTEM, CYLINDER HEAD USED FOR POSITIVE CRANKCASE VENTILATION SYSTEM, INTERNAL COMBUSTION ENGINE INCLUDING POSITIVE CRANKCASE VENTILATION SYSTEM, AND POSITIVE CRANKCASE VENTILATION METHOD

(75) Inventors: Satoshi Hirano, Nagoya (JP); Yasuaki Imai, Nishikamo-gun (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 1026 days.

(21) Appl. No.: 12/528,682

(22) PCT Filed: Feb. 28, 2008

(86) PCT No.: PCT/IB2008/001379

§ 371 (c)(1),
(2), (4) Date: Aug. 26, 2009

(87) PCT Pub. No.: WO2008/104892

PCT Pub. Date: Sep. 4, 2008

(65) Prior Publication Data

US 2010/0101514 A1 Apr. 29, 2010

(30) Foreign Application Priority Data

Feb. 28, 2007 (JP) ..... 2007-048602

(51) Int. Cl.

| | |
|---|---|
| ***F02M 13/00*** | (2006.01) |
| ***F02F 1/42*** | (2006.01) |
| ***F02F 7/00*** | (2006.01) |
| ***F02B 25/06*** | (2006.01) |

(52) U.S. Cl.
USPC ..... 123/572; 123/41.86; 123/573; 123/574; 123/193.5; 123/195 C

(58) Field of Classification Search
USPC ..... 123/572–574, 41.86, 193.5, 195 C
See application file for complete search history.

(56) References Cited

U.S. PATENT DOCUMENTS 4,541,399 A * 9/1985 Tanaka et al. ..... 123/573
4,627,406 A * 12/1986 Namiki et al. ..... 123/573

(Continued)

FOREIGN PATENT DOCUMENTS

DE 40 33 844 A1 4/1991
JP 62-000721 U 1/1987

(Continued)

OTHER PUBLICATIONS

Partial translation of Japanese Office Action for corresponding JP Patent Application No. 2007-048602 issued on Jan. 29, 2013.

*Primary Examiner* — Thanh K Truong
*Assistant Examiner* — Tea Holbrook
(74) *Attorney, Agent, or Firm* — Sughrue Mion, PLLC

(57) ABSTRACT

A blow-by gas collection passage (91) extends in a cylinder block (1) and a cylinder head (3). A crank chamber (61) is connected to an oil separator (92) through the blow-by gas collection passage (91). A cutout portion is formed in an upper end portion of a wall portion (97) of the blow-by gas collection passage (91), and the oil separator (92) contacts an upper surface of the cylinder head (3) to form a connection portion (98) through which the blow-by gas collection passage (91) is connected to a cam chamber (3A). Thus, new air in the cam chamber (3A) flows into the blow-by gas collection passage (91) at an inlet portion of the oil separator (92) through the connection portion (98) to dilute the blow-by gas.

6 Claims, 10 Drawing Sheets

(56) References Cited

U.S. PATENT DOCUMENTS

| | | | | |
|---|---|---|---|---|
| 4,656,991 | A * | 4/1987 | Fukuo et al. | 123/572 |
| 4,667,647 | A * | 5/1987 | Ohtaka et al. | 123/573 |
| 5,069,192 | A * | 12/1991 | Matsumoto et al. | 123/572 |
| 5,285,754 | A | 2/1994 | Bell | |
| 5,329,913 | A * | 7/1994 | Suzuki et al. | 123/573 |
| 5,850,823 | A * | 12/1998 | Kasahara | 123/572 |
| 6,234,154 | B1 * | 5/2001 | Spix | 123/572 |
| 6,491,556 | B2 * | 12/2002 | Muramatsu et al. | 440/88 R |
| 6,889,674 | B2 * | 5/2005 | Pateman et al. | 123/574 |
| 7,047,955 | B2 * | 5/2006 | Ookawa et al. | 123/572 |
| 7,210,471 | B2 * | 5/2007 | Ikeda et al. | 123/572 |
| 7,578,277 | B2 * | 8/2009 | Inui et al. | 123/192.2 |
| 7,712,456 | B2 * | 5/2010 | Hirano | 123/572 |
| 2002/0134361 | A1 * | 9/2002 | Okamoto | 123/572 |
| 2004/0159314 | A1 * | 8/2004 | Ishizuka et al. | 123/572 |
| 2005/0092268 | A1 * | 5/2005 | Girard | 123/41.86 |
| 2008/0011280 | A1 * | 1/2008 | Tawarada et al. | 123/572 |
| 2008/0035128 | A1 * | 2/2008 | Richardson | 123/574 |
| 2008/0047519 | A1 * | 2/2008 | Naito et al. | 123/193.5 |
| 2008/0110443 | A1 * | 5/2008 | Hirano | 123/572 |

FOREIGN PATENT DOCUMENTS

| | | | |
|---|---|---|---|
| JP | 04-059322 | U | 5/1992 |
| JP | 07-46724 | Y2 | 10/1995 |
| JP | 11-223118 | A | 8/1999 |
| JP | 2000-008951 | A | 1/2000 |
| JP | 2005-133552 | A | 5/2005 |
| JP | 3859041 | B2 | 9/2006 |

* cited by examiner

POSITIVE CRANKCASE VENTILATION SYSTEM, CYLINDER HEAD USED FOR POSITIVE CRANKCASE VENTILATION SYSTEM, INTERNAL COMBUSTION ENGINE INCLUDING POSITIVE CRANKCASE VENTILATION SYSTEM, AND POSITIVE CRANKCASE VENTILATION METHOD

BACKGROUND OF THE INVENTION

1. Field of the Invention

The invention relates to a positive crankcase ventilation system (hereinafter, referred to as "PCV system") that delivers blow-by gas in an internal combustion engine provided in a vehicle or the like to an intake system. The invention also relates to a cylinder head used for the PCV system, an internal combustion engine including the PCV system, and a positive crankcase ventilation method. Particularly, the invention relates to improvement of a PCV system that includes a blow-by gas collection passage through which an inside of a crankcase is connected to an inside of a breather chamber, and improvement of a positive crankcase ventilation method.

2. Description of the Related Art

In related art, an internal combustion engine for a vehicle includes a PCV system that introduces blow-by gas, which has been blown into a crankcase through a gap between a cylinder and a piston, into an intake system. That is, using the PCV system, the blow-by gas, which contains nitrogen oxide (NOx), carbon monoxide (CO), hydrocarbon (HC), and the like, is delivered to a combustion chamber through the intake system for the engine. This prevents the blow-by gas from being discharged into the atmospheric air. Also, the PCV system introduces new air (outside air) into the crankcase to ventilate the crankcase, thereby suppressing deterioration of engine oil due to the blow-by gas, and maintaining lubricating performance and the like for a long time.

As described in Japanese Patent Application Publication No. 2000-8951 (JP-A-2000-8951), the PCV system includes an oil separator. Oil mist contained in the blow-by gas is separated from the blow-by gas in the oil separator, and the oil is delivered to an oil accumulation portion such as an oil pan. After the oil mist is separated and removed from the blow-by gas, the blow-by gas is returned to the intake system for the engine. As described in the publication No. 2000-8951, for example, the oil separator is disposed in a cylinder head cover of the engine (hereinafter, simply referred to as "head cover").

For example, Japanese Utility Model Publication No. 7-46724 (JP-UM-A-7-46724), Japanese Patent Application Publication No. 11-223118 (JP-A-11-223118), and Japanese Patent Application Publication No. 2005-133552 (JP-A-2005-133552) describe a configuration where a blow-by gas collection passage, through which an inside of a crankcase is connected to an inside of an oil separator, is provided to increase the level of performance of collecting the blow-by gas from the inside of the crankcase.

In the system that includes the blow-by gas collection passage, for example, an air introduction passage and an oil return passage are provided separately from the blow-by gas collection passage. New air for ventilation is introduced into the crankcase through the air introduction passage. Oil separated from the blow-by gas in the oil separator is delivered downward and collected into an oil pan through the oil return passage.

FIG. 10 is a schematic diagram showing the general configuration of an engine "a" that includes a blow-by gas collection passage "b", and a manner in which fluids (blow-by gas, new air, and oil) flow in the engine "a". In FIG. 10, the solid line arrows indicate the flow of the blow-by gas, the dashed line arrows indicate the flow of the new air, and the chain line arrows indicate the flow of the oil.

As shown in FIG. 10, the blow-by gas collection passage "b" is formed to extend in a cylinder block "d" and a cylinder head "e". An upper end of the blow-by gas collection passage "b" is directly connected to an inside of an oil separator "g" provided in a head cover "f". That is, the inside of the crankcase "c" is connected to the inside of the oil separator "g" through the blow-by gas collection passage "b". After the blow-by gas is introduced into the oil separator "g" from the inside of the crankcase "c" through the blow-by gas collection passage "b", the oil mist is separated and removed from the blow-by gas in the separator "g". Then, the blow-by gas is introduced into the intake system.

The oil separated and removed from the blow-by gas flows downward into a cam chamber "i" through an oil discharge hole "h" formed in the oil separator "g". Then, the oil is collected into an oil pan "k" through an oil return passage "j", using the self weight of the oil. In the system shown in FIG. 10, the oil return passage "j" is used also as an air introduction passage. The new air introduced into the cam chamber "i" flows into the crankcase "c" along with the oil through the oil return passage "j". Thus, the blow-by gas in the crankcase "c" is diluted with the new air. That is, the blow-by gas diluted with the new air flows toward the oil separator "g" through the blow-by gas collection passage "b".

In most cases, the blow-by gas collection passage "b" is disposed at a position under the influence of the temperature of outside air, due to limitations of space where the blow-by gas collection passage is disposed. Particularly, in a portion of the blow-by gas collection passage "b", which is located in the cylinder head "e" disposed above the combustion chamber (i.e., a portion where the temperature is highest), the temperature is relatively low (for example, approximately 5° C. during winter time).

Therefore, when the blow-by gas collected from the inside of the crankcase "c" flows through the portion of the blow-by gas collection passage "b", which is located in the cylinder head "e", the blow-by gas is cooled. Accordingly, moisture contained in the blow-by gas may be condensed near an inlet portion of the oil separator "g" (i.e., a portion A in FIG. 10), and inside the oil separator "g".

In this situation, nitrogen oxide (NOx) in the blow-by gas may be combined with condensation water, and sludge may be generated at the inlet portion of the oil separator "g", and inside the oil separator "g". If a large amount of sludge is generated, the oil discharge hole "j" through which the oil separated from the blow-by gas is returned to the cam chamber "i", and the oil return passage "j" through which the oil is returned to the oil pan "k" may be blocked by the sludge. This may make it impossible to discharge the oil from the oil separator "g" toward the oil pan "k".

If it is impossible to discharge the oil into the oil pan "k", a large amount of liquid oil is accumulated in the oil separator "g", and the liquid oil is delivered into the intake system for the engine along with the blow-by gas. This may decrease the output from the engine, and increase the amount of oil consumption. Also, in the system where the oil return passage "i" is used also as the air introduction passage, it may be difficult to introduce new air into the crankcase "c".

Further, the generation of sludge may adversely affect a valve operating system of the engine "a", and interfere with the normal opening/closing operation of an intake valve and an exhaust valve.

As means for suppressing the generation of the sludge, the diameter of the passage through which the new air is introduced into the crankcase "c" may be increased to increase the amount of new air introduced into the crankcase "c". In this case, it is possible to reduce the concentration of NOx in the crankcase "c" (i.e., dilute the blow-by gas in the crankcase "c"), thereby reducing the concentration of NOx in the fluid (i.e., the mixed gas of the blow-by gas and the new air) flowing through the blow-by gas collection passage "b".

However, in the configuration where the amount of new air introduced into the crankcase "c" is increased, the flow speed of the fluid in the blow-by gas collection passage "b" is increased. This increases the amount of oil mist that flows from the inside of the crankcase "c" toward the oil separator "g" along with the blow-by gas, that is, the amount of oil mist introduced into the oil separator "g". In this case, the oil separation function of the oil separator "g" may be insufficient. Accordingly, it may be necessary to replace the oil separator "g" with an oil separator with a larger size, or an oil separator with a higher oil separation function. This increases the cost.

Also, because the amount of new air introduced into the crankcase "c" is increased, the amount of air introduced into the intake system for the engine from the PCV system is increased. In general, the air is introduced into the intake system from the PCV system at a position downstream of an airflow meter (more specifically, downstream of a throttle valve). Also, the amount of fuel injected into the engine is set based on an intake air amount detected by the airflow meter so that an air-fuel ratio is equal to a predetermined air-fuel ratio. Therefore, if the amount of air introduced into the intake system for the engine from the PCV system is increased, the amount of air that is actually introduced into the cylinder is much larger than the intake air amount used for the calculation of the fuel injection amount. As a result, the air-fuel ratio may be higher than the predetermined air-fuel ratio. As a result, a desired engine out may not be obtained, or an engine speed may be unstable during idling operation of the engine (i.e., rough idling may be caused).

SUMMARY OF THE INVENTION

The invention provides a positive crankcase ventilation system that includes a blow-by gas collection passage, wherein generation of sludge is suppressed while a high level of blow-by gas collection performance, which is obtained by providing the blow-by gas collection passage, is maintained. The invention also provides a cylinder head used for the positive crankcase ventilation system, an internal combustion engine including the positive crankcase ventilation system, and a positive crankcase ventilation method.

A first aspect of the invention relates to a positive crankcase ventilation system that includes a blow-by gas collection passage through which an inside of a crankcase is connected to a first breather chamber (an inner space of an oil separator). In the positive crankcase ventilation system, blow-by gas is diluted at a position immediately upstream of an inlet of the first breather chamber, by partially connecting an inner space of a cylinder head, in which new air is present, to the blow-by gas collection passage.

More specifically, the first aspect relates to a positive crankcase ventilation system that is provided in an internal combustion engine, and that includes an air introduction passage through which new air present in an inner space of a cylinder head is introduced into a crankcase from the inner space of the cylinder head, and a blow-by gas collection passage through which a first breather chamber provided in an upper portion of a cylinder is connected to an inside of the crankcase, wherein blow-by gas in the crankcase is delivered to an intake system through the blow-by gas collection passage and the first breather chamber. In the positive crankcase ventilation system, the blow-by gas collection passage is formed by a partition wall that separates the blow-by gas collection passage from the inner space of the cylinder head; and a connection portion, through which the inner space of the cylinder head is connected to the blow-by gas collection passage, is provided in the partition wall.

According to the first aspect, when the operation of collecting the blow-by gas is performed, the new air present in the inner space of the cylinder head is introduced into the crankcase from the inner space of the cylinder head through the air introduction passage, and thus, the crankcase is ventilated. The blow-by gas in the crankcase flows toward the first breather chamber (for example, the oil separator) provided in the upper portion of the cylinder through the blow-by gas collection passage. Immediately before the blow-by gas flows into the first breather chamber, part of the new air present in the inner space of the cylinder head flows into the blow-by gas collection passage through the connection portion provided in the partition wall that separates the blow-by gas collection passage from the inner space of the cylinder head. As a result, the blow-by gas is further diluted. Because the blow-by gas at the inlet of the first breather chamber and inside the first breather chamber is the diluted blow-by gas, the generation of sludge is suppressed. That is, the blow-by gas collection passage is provided to increase the level of the blow-by gas collection performance, and in addition, the concentration of the blow-by gas is reduced by further diluting the blow-by gas with the new air at the position immediately upstream of the first breather chamber, instead of introducing the blow-by gas in the crankcase into the first breather chamber without changing the concentration of the blow-by gas. Accordingly, it is possible to prevent problems caused by generation of sludge (for example, blockage of an oil return passage, and an adverse effect on a valve operating system). Also, because the new air is mixed into the blow-by gas to dilute the blow-by gas at the position immediately upstream of the first breather chamber, the flow rate of the fluid (mixed fluid of the blow-by gas and the new air) in the blow-by gas collection passage is not increased. Therefore, it is possible to avoid the situation where the flow speed of the fluid in the blow-by gas collection passage is increased, and therefore, the amount of oil mist that flows along with the blow-by gas and flows into the first breather chamber is increased.

In the positive crankcase ventilation system according to the above-described aspect, one end of the air introduction passage may be connected to the inner space of the cylinder head, and another end of the air introduction passage may be connected to the inside of the crankcase; and the new air that flows into the inner space of the cylinder head from the intake system may be introduced into the crankcase through the air introduction passage.

Further, the connection portion may adjust a concentration of the blow-by gas so that the concentration of the blow-by gas in the inner space of the cylinder head is lower than the concentration of the blow-by gas in the first breather chamber, and the concentration of the blow-by gas in the first breather chamber is lower than the concentration of the blow-by gas in the crankcase. In this case, in the positive crankcase ventilation system according to the aspect, a concentration of nitrogen oxide contained in the blow-by gas in the inner space of the cylinder head may be lower than the concentration of the nitrogen oxide contained in the blow-by gas in the first breather chamber, and the concentration of the nitrogen oxide contained in the blow-by gas in the first breather chamber may be lower than the concentration of the nitrogen oxide contained in the blow-by gas in the crankcase.

It is possible to set the concentration of the blow-by gas in each of the inner space of the cylinder head, the first breather chamber, and the crankcase, to any value, by appropriately setting the shape (connection area) of the connection portion provided in the partition wall. For example, the concentration of the blow-by gas in the first breather chamber may be set to a value at which the generation of sludge is suppressed even when condensation water is generated. The concentration of the blow-by gas in the crankcase is set to a value at which deterioration of oil accumulated in an oil pan is suppressed. That is, as the amount of new air flowing through the connection portion increases, the concentration of the blow-by gas in the first breather chamber decreases, and the concentration of the blow-by gas in the crankcase increases. As the amount of new air flowing through the connection portion decreases, the concentration of the blow-by gas in the first breather chamber increases, and the concentration of the blow-by gas in the crankcase decreases. Therefore, by designing the shape of the connection portion so that the concentration of the blow-by gas in the first breather chamber and the concentration of the blow-by gas in the crankcase are in respective permissible concentration ranges, it is possible to suppress the generation of sludge and the deterioration of the oil.

Further, a connection area of the connection portion between the inner space of the cylinder head and the blow-by gas collection passage may be smaller than a cross sectional area of the blow-by gas collection passage.

In this configuration as well, it is possible to obtain the same advantageous effects as those obtained by the above-described aspect. That is, the level of the blow-by gas collection performance is increased by providing the blow-by gas collection passage, and in addition, the generation of sludge is suppressed at the inlet of the first breather chamber and inside the first breather chamber. Also, by limiting the connection area of the connection portion, it is possible to reduce the amount of new air flowing into the blow-by gas collection passage, to a required minimum amount.

The first breather chamber may be formed by a breather case attached to a head cover provided on the cylinder head; and the connection portion may be a gap between a cutout portion formed in an upper end portion of the partition wall, and a lower surface of the breather case.

In this case, the partition wall may include a protruding portion that protrudes toward the inner space of the cylinder head; an inside of the protruding portion may function as the blow-by gas collection passage; an upper end of the protruding portion may be disposed at a position lower than an upper end portion of the cylinder head by forming the cutout portion; and the connection portion may be a gap between the upper end of the protruding portion and the lower surface of the breather case when the lower surface of the breather case contacts an upper end surface of the cylinder head.

In the configuration, the connection portion is formed only by forming the cutout portion in the cylinder head. Therefore, when the cylinder head is manufactured, a manufacturing process (for example, a casting process) is simplified. This reduces manufacturing cost. Also, in the system where the connection portion is formed between the upper end of the protruding portion and the lower surface of the breather case, the new air is introduced into a relatively large range in the circumferential direction of the blow-by gas collection passage. Therefore, the blow-by gas is diluted by mixing the new air into the blow-by gas in a relatively large area in the blow-by gas collection passage. Accordingly, the entire blow-by gas to be introduced into the first breather chamber is uniformly diluted.

The following configurations are made taking into account the operating state of the internal combustion engine in which the amount of generated blow-by gas increases. In the first breather chamber, oil contained in the blow-by gas introduced into the first breather chamber through the blow-by gas collection passage may be separated from the blow-by gas. Also, a second breather chamber connected to the inner space of the cylinder head with the intake system for the internal combustion engine may be provided in the upper portion of the cylinder. In the second breather chamber, the oil may be separated from the blow-by gas.

Thus, when the amount of generated blow-by gas is relatively small (when the internal combustion engine is operated in a relatively low-load state, which will be referred to as a "steady state"), the new air flows from the intake system for the internal combustion engine into the second breather chamber, and then, the new air flows from the second breather chamber into the crankcase through the inner space of the cylinder head and the air introduction passage. Thus, the crankcase is ventilated. Also, in this case, as described above, part of the new air in the inner space of the cylinder head flows into the blow-by gas collection passage through the connection portion to further dilute the blow-by gas. Thus, the generation of sludge is suppressed at the inlet of the first breather chamber and inside the first breather chamber.

When the amount of generated blow-by gas increases, for example, when the internal combustion engine is in a high-speed and high-load state, the blow-by gas flows from the inside of the crankcase into the blow-by gas collection passage, and then, part of the blow-by gas flows into the first breather chamber. Then, after the oil is separated and removed from the part of the blow-by gas in the first breather chamber, the part of the blow-by gas is returned to the intake pipe for the engine. The rest of the blow-by gas flows into the inner space of the cylinder head through the connection portion. That is, the blow-by gas flows through the connection portion in a direction opposite to the above-described direction of the flow of the new air (i.e., the flow of the new air when the engine is in a steady state). Then, the blow-by gas flows from the inner space of the cylinder head into the second breather chamber. After the oil is separated and removed from the blow-by gas in the second breather chamber, the blow-by gas is returned to the intake pipe for the engine. Because the blow-by gas is collected in the plurality of breather chambers (i.e., the oil is removed from the blow-by gas in the plurality of breather chambers, and then, the blow-by gas is delivered from the plurality of breather chambers into the intake system) in the above-described manner, it is possible to increase the level of the blow-by gas handling performance of the positive crankcase ventilation system when the internal combustion engine is in a high-speed and high-load state.

A second aspect of the invention relates to a cylinder head used for the positive crankcase ventilation system in the above-described aspect. A third aspect of the invention relates to an internal combustion engine including the positive crankcase ventilation system in the above-described aspect. That is, the second aspect relates to a cylinder head in which the connection portion, through which the inner space of the cylinder head is connected to the blow-by gas collection passage, is provided in the partition wall that separates the blow-by gas collection passage from the inner space of the cylinder head. The third aspect relates to an internal combustion engine in which the blow-by gas in the crankcase is delivered to the intake system through the blow-by gas collection passage and the first breather chamber, and the blow-by gas mixed with intake air is introduced into a combustion chamber.

A fourth aspect of the invention relates to a positive crankcase ventilation method that includes the steps of introducing new air, which is introduced into an inner space of a cylinder head, into a crankcase from the inner space of the cylinder head, in an internal combustion engine; diluting blow-by gas in the crankcase with the introduced new air; introducing the diluted blow-by gas into a blow-by gas collection passage through which a first breather chamber provided in an upper portion of a cylinder is connected to an inside of the crankcase; further diluting the diluted blow-by gas by introducing the new air into the blow-by gas collection passage through a connection portion, wherein the connection portion is formed in a partition wall that separates the blow-by gas collection passage from the inner space of the cylinder head, and the inner space of the cylinder head is connected to the blow-by gas collection passage through the connection portion; and delivering the further diluted blow-by gas to an intake system through the first breather chamber.

The above-described positive crankcase ventilation method may further include separating and removing oil contained in the blow-by gas from the blow-by gas in the first breather chamber; and returning the separated oil into an oil pan through the inner space of the cylinder head and the crankcase.

In the above-described positive crankcase ventilation method, a concentration of the blow-by gas may be adjusted so that the concentration of the blow-by gas in the inner space of the cylinder head is lower than the concentration of the blow-by gas in the first breather chamber, and the concentration of the blow-by gas in the first breather chamber is lower than the concentration of the blow-by gas in the crankcase.

According to the invention, in the positive crankcase ventilation system that includes the blow-by gas collection passage through which the inside of the crankcase is connected to the first breather chamber, the blow-by gas is diluted at the position immediately upstream of the inlet of the first breather chamber, by partially connecting the inner space of the cylinder head, in which new air is present, to the blow-by gas collection passage. Therefore, it is possible to suppress the generation of sludge by reducing the concentration of the blow-by gas at the position immediately upstream of the first breather chamber, while maintaining the high level of blow-by gas collection performance obtained by providing the blow-by gas collection passage. Also, because the flow rate of the fluid in the blow-by gas collection passage is not increased, it is also possible to avoid an increase in the amount of oil mist that flows along with the blow-by gas and flows into the first breather chamber.

BRIEF DESCRIPTION OF THE DRAWINGS

The foregoing and further objects, features and advantages of the invention will become apparent from the following description of embodiments with reference to the accompanying drawings, wherein like numerals are used to represent like elements and wherein:

FIG. 8A is a perspective view showing a portion of a cylinder head, in which a blow-by gas collection passage is formed, and FIG. 8B is a plane view showing the same portion of the cylinder head;

FIG. 9A is a perspective view showing a portion of a cylinder head, in which a blow-by gas collection passage is formed, and FIG. 9B is a plane view showing the same portion of the cylinder head.

DETAILED DESCRIPTION OF EMBODIMENTS

Hereinafter, an embodiment of the invention will be described with reference to the drawings. In the embodiment, a PCV system (positive crankcase ventilation system) according to the invention is applied to an inline multi-cylinder engine (internal combustion engine) for a vehicle (for example, an inline four-cylinder engine).

[Description of the Entire Configuration of an Engine]

Figure 1:
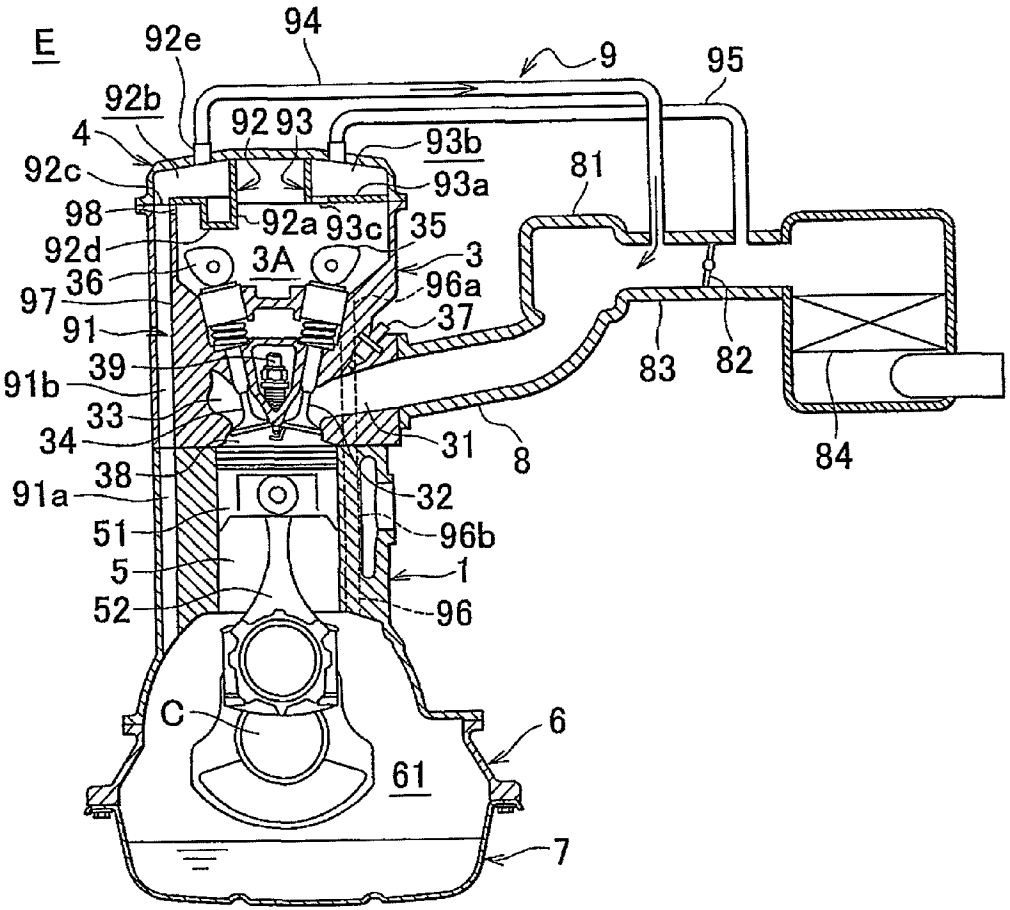
FIG. 1 is a schematic configuration diagram showing an inside of an engine according to an embodiment and an intake system, taken along a plane perpendicular to an axis of a crankshaft.

FIG. 1 is a schematic configuration diagram showing an inside of an engine E and an intake system, taken along a plane perpendicular to an axis of a crankshaft C. For example, the engine E is installed transversely in an engine room. The right side in FIG. 1 indicates the front side of a vehicle. However, the engine E need not necessarily installed transversely. The engine E may be installed longitudinally.

As shown in FIG. 1, the engine E includes a cylinder head 3 installed on an upper end portion of a cylinder block 1, and a head cover 4 attached to an upper end of the cylinder head 3.

A plurality of cylinders (for example, four cylinders) 5 are provided in the cylinder block 1. A piston 51, which reciprocates, is housed in each cylinder 5. Each piston 51 is connected to the crankshaft C through a connecting rod 52 to transmit power. Further, a crankcase 6 is attached to a lower portion of the cylinder block 1. A space that extends over a lower portion of an inside of the cylinder block 1 and an inside of the crankcase 6 constitutes a crank chamber 61. An oil pan 7 where oil is accumulated is provided under the crankcase 6.

Intake valves 32 that open/close respective intake ports 31, and exhaust valves 34 that open/close respective exhaust ports 33 are fitted to the cylinder head 3. Camshafts 35 and 36 are disposed in a cam chamber 3A formed between the cylinder head 3 and the head cover 4 (an inner space of the cylinder head 3). The valves 32 and 34 are opened/closed by rotating the camshafts 35 and 36.

An intake manifold 8 is connected to the intake ports 31 formed in the cylinder head 3. An upstream portion of the intake manifold 8 is connected to an intake pipe 83 provided with a surge tank 81 and a throttle valve 82. An air cleaner 84 is provided in an upstream portion of the intake pipe 83. Thus, air introduced into the intake pipe 83 from the air cleaner 84 is introduced into the intake manifold 8 through the surge tank 81. Injectors (fuel injection valves) 37 are provided in the cylinder head 3. Air introduced into each intake port 31 is mixed with fuel injected from the corresponding injector 37 to form air-fuel mixture. The air-fuel mixture is introduced into a combustion chamber 38 when the intake valve 32 is opened.

An ignition plug 39 is provided in a top portion of the combustion chamber 38. When the ignition plug 39 ignites the air-fuel mixture, the air-fuel mixture is combusted, and thus, the piston 51 reciprocates. The reciprocating movement of the piston 51 is transmitted to the crankshaft C through the connecting rod 52, and converted to the rotational movement of the crankshaft C. The engine E produces an output in this manner.

When the exhaust valve 34 is opened, combustion gas generated by the combustion of the air-fuel mixture is discharged to an exhaust manifold (not shown) through an exhaust port 33, and then, discharged to the outside through an exhaust pipe. A catalytic converter (not shown) is provided in the exhaust pipe. The catalytic converter purifies hydrocarbon (HC), carbon monoxide (CO), and nitrogen oxide (NOx).

[ECU]

Figure 2:
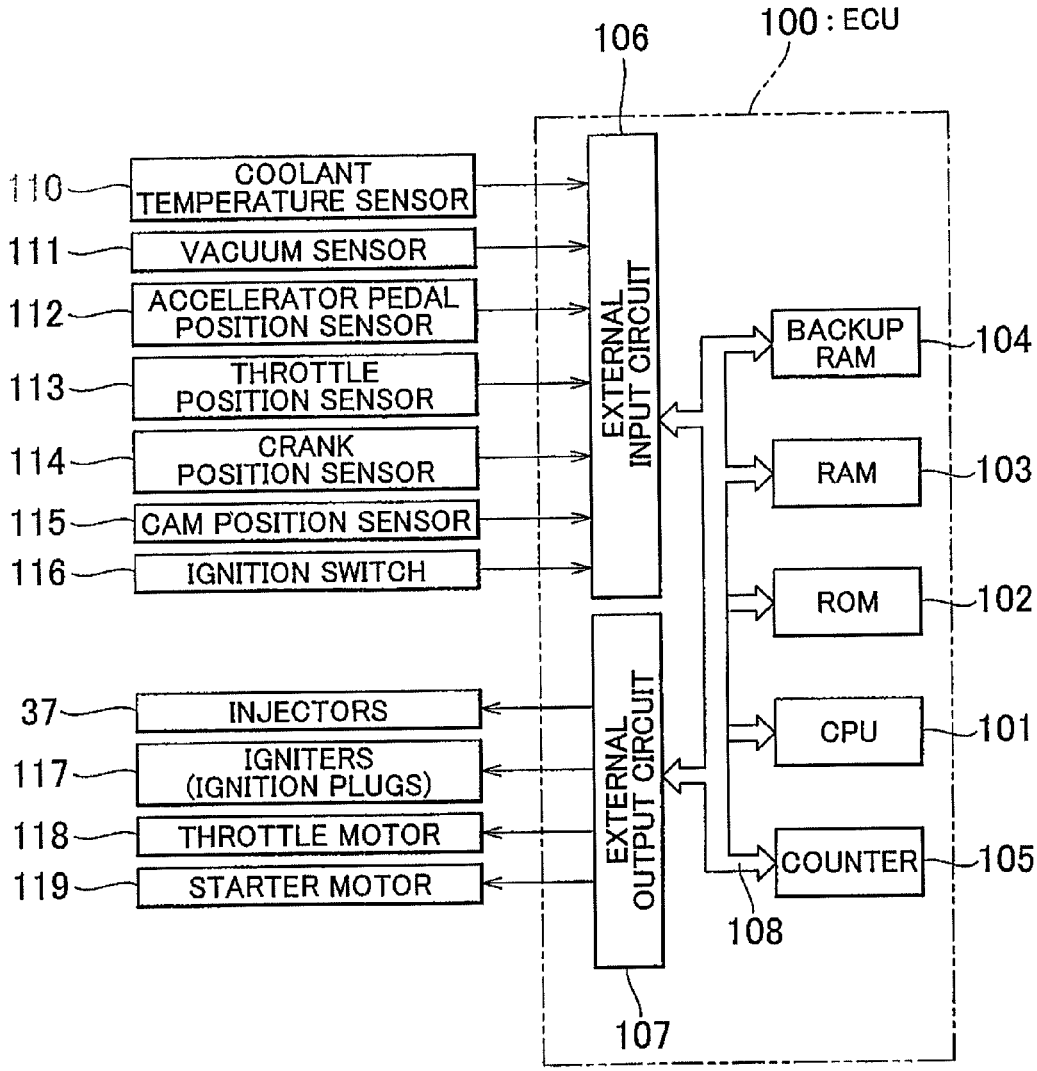
FIG. 2 is a block diagram showing a configuration of a control system.

An ECU (electronic control unit) 100 controls the operation of the engine E with the above-described configuration. As shown in FIG. 2, the ECU 100 includes a CPU 101, a ROM 102, a RAM 103, a backup RAM 104, and a counter 105 that counts the number of times that fuel injection is performed.

The ROM 102 stores, for example, control programs, and maps that are referred to when the control programs are executed. The CPU 101 performs computations based on the control programs and the maps stored in the ROM 102. The RAM 103 is a memory that temporarily stores, for example, results of computations performed by the CPU 101, and data input from sensors. The backup RAM 104 is a nonvolatile memory that stores, for example, data that should be reserved when the engine E is stopped. The CPU 101, the ROM 102, the RAM 103, the backup RAM 104, and the counter 105 are connected to each other via a bus 108, and connected to an external input circuit 106 and an external output circuit 107.

The external input circuit 106 is connected to, for example, a coolant temperature sensor 110, a vacuum sensor 111, an accelerator pedal position sensor 112, a throttle position sensor 113, a crank position sensor 114, a cam position sensor 115, and an ignition switch 116. The coolant temperature sensor 110 detects the temperature of the coolant circulated in a water jacket of the engine E. The vacuum sensor 111 detects an intake pressure in an area downstream of the throttle valve 82. The accelerator pedal position sensor 112 detects the operation amount of an accelerator pedal. The throttle position sensor 113 detects the opening degree of the throttle valve 82. The crank position sensor 114 transmits a pulse signal according to the rotational speed of the crankshaft C. The cam position sensor 115 transmits a pulse signal according to the rotational speed of the camshafts 35 and 36.

The external output circuit 107 is connected to, for example, the injectors 37, igniters 117 that operate the respective ignition plugs 39, a throttle motor 118 that operates the throttle valve 82, and a starter motor 119 that performs cranking of the engine E when the engine E is started.

The ECU 100 executes controls for the engine E, which include a control of opening/closing of each injector 37 (i.e., a control of a fuel injection start timing, and a fuel injection end timing), based on the outputs from the sensors such as the coolant temperature sensor 110, the vacuum sensor 111, the accelerator pedal position sensor 112, the throttle position sensor 113, the crank position sensor 114, and the cam position sensor 115.

[Description of a PCV System]

Next, a PCV system 9 according to the embodiment will be described. The PCV system 9 introduces blow-by gas, which has blown into the crank chamber 61 through a gap between an inner surface of the cylinder 5 and an outer surface of the piston 51, into the intake system for the engine E. Also, the PCV system 9 introduces new air into the crank chamber 61 to ventilate the crank chamber 61.

The PCV system 9 includes a blow-by gas collection passage 91 (refer to FIG. 1), a first oil separator 92, a second oil separator 93, a blow-by gas supply pipe 94, an air introduction pipe 95, and an air introduction passage 96. The blow-by gas, which has blown into the crank chamber 61, is drawn out through the blow-by gas collection passage 91. In the first oil separator (negative pressure-side oil separator: first breather chamber) 92, oil mist is separated from the blow-by gas that has been drawn out through the blow-by gas collection passage 91. Outside air (new air) is introduced into the second oil separator 93 (atmospheric air-side oil separator: second breather chamber) 93. The blow-by gas is introduced into the intake system from the first oil separator 92 through the blow-by gas supply pipe 94. The new air is introduced into the second oil separator 93 through the air introduction pipe 95. The new air is introduced into the crank chamber 61 from an inside of the cam chamber 3A through the air introduction passage 96.

Figure 3:
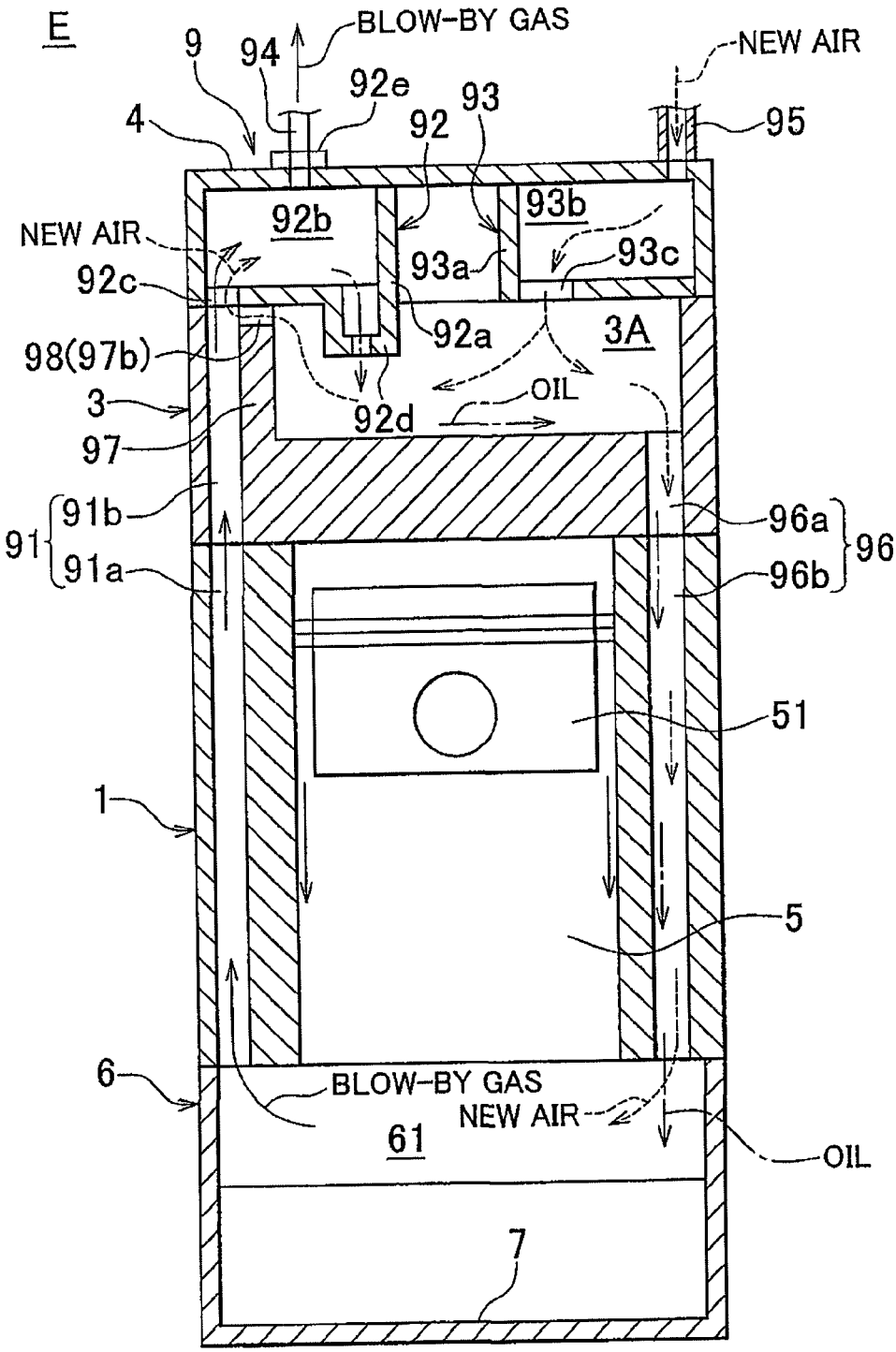
FIG. 3 is a schematic configuration diagram of the engine, which illustrates flows of blow-by gas, new air, and oil when the engine is operated in a steady state.

FIG. 3 is a schematic diagram showing a manner in which the blow-by gas, the new air, and oil flow in the engine E. In FIG. 3, the solid line arrows indicate the flow of the blow-by gas, the dashed line arrows indicate the flow of the new air, and the chain line arrows indicate the flow of the oil. Hereinafter, the configuration of the PCV system 9 will be described with reference to FIG. 1 and FIG. 3.

The blow-by gas collection passage 91 is formed to extend in the cylinder block 1 and the cylinder head 3 in a substantially vertical direction. That is, a passage 91*a* formed in the cylinder block 1 and a passage 91*b* formed in the cylinder head 3 are coaxially positioned to extend in the substantially vertical direction so that the passages 91*a* and 91*b* are connected to each other. Thus, the inside of the crank chamber 61 is connected to the inner space of the first oil separator 92 (i.e., a separator chamber 92*b* described later) through the blow-by gas collection passage 91.

Thus, when the blow-by gas is collected, the blow-by gas in the crank chamber 61 is introduced into the first oil separator 92 through the blow-by collection passage 91.

In the embodiment, one blow-by gas passage 91 is provided. However, a plurality of blow-by gas passages may be provided.

The first oil separator 92 is attached to one side (the left side in FIG. 1 and FIG. 3) of an inner surface of the head cover 4 (i.e., a surface of the head cover 4, which faces the cylinder head 3). The first oil separator 92 includes a separator case (breather case) 92*a*, and a plurality of baffle plates (not shown) disposed in the separator case 92*a*.

The separator case 92*a* is a box-shaped member, that is, the separator case 92*a* has a substantially rectangular parallelepiped shape. The first separator case 92 is made of metal or resin. The upper side and one lateral side (the left side in FIG. 1 and FIG. 3) of the separator case 92*a* are open. The separator case 92*a* is attached to the inner surface of the head cover 4 so that the open upper side and the open lateral side axe closed by the inner surface of the head cover 4. Thus, the separator chamber (blow-by gas flow passage) 92*b*, which is substantially sealed, is formed between the separator case 92*a* and the head cover 4. The separator case 92*a* is attached to the inner surface of the head cover 4, for example, using a bolt. In this embodiment, the separator chamber 92*b* is formed by the separator case 92*a* and the inner surface of the head cover 4. However, the separator chamber 92*b* may be formed only by the separator case 92*a*.

A blow-by gas introduction hole 92*c* and an oil collection portion 92*d* are formed in the separator case 92*a*. Also, a PCV valve 92*e* is provided for the separator case 92*a*.

The blow-by gas introduction hole 92*c* is formed on a bottom surface of the separator case 92*a* at a position in one side in the longitudinal direction of the separator case 92*a* (i.e., at a position in one side of the separator case 92*a* in a direction in which cylinders are arranged when the separator case 92*a* is attached to the head cover 4). As described above, the inner space of the first oil separator 92 (i.e., the separator chamber 92*b*) is directly connected to the blow-by gas collection passage 91. Therefore, the blow-by gas introduction hole 92*c* is formed to face the blow-by gas collection passage 91. That is, when the head cover 4 is installed on an upper end surface of the cylinder head 3, a lower surface of the separator case 92*a* contacts the upper end surface of the cylinder head 3, and an upper end of the blow-by gas collection passage 91 is connected to the blow-by gas introduction hole 92*c* (the configuration of this portion will be described in detail later).

The oil collection portion 92*d*, which functions as a so-called oil pool, is provided in the bottom surface of the separator case 92*a*. That is, the oil collection portion 92*d* is a protruding portion of the bottom surface of the separator case 92*a*, which protrudes downward. Also, an opening with a relatively small diameter is formed in the protruding portion of the bottom surface. Thus, the inner space of the separator case 92*a* is connected to the cam chamber 3A through the opening with the small diameter. In addition, because oil is accumulated in the oil collection portion 92*d* (oil pool), it is possible to prevent the oil mist in the cam chamber 3A from flowing into the inner space of the separator case 92*a* through the oil collection portion 92*d*.

The PCV valve 92*e* is opened according to a pressure in the inner space of the separator case 92*a* and an intake negative pressure in the intake system. When the PCV valve 92*e* is opened, the blow-by gas, from which the oil has been separated and removed in the separator case 92*a*, is introduced into the intake system for the engine E (i.e., an area downstream of the throttle valve 82) through the PCV valve 92*e*. The PCV valve 92*e* may be constituted by an electromagnetic valve that is openable and closable.

The second oil separator 93 has the substantially same configuration as that of the above-described first oil separator 92. That is, the second oil separator 93 is attached to the other side (the right side in FIG. 1 and FIG. 3) of the inner surface of the head cover 4 (i.e., the surface of the head cover 4, which faces the cylinder head 3). The second oil separator 93 includes a separator case 93*a*, and a plurality of baffle plates (not shown) disposed in the separator case 93*a*. Thus, a separator chamber 93*b*, which is substantially sealed, is formed between the second oil separator 93 and the head cover 4. In this embodiment, the separator chamber 93*b* is formed by the separator case 93*a* and the inner surface of the head cover 4. However, the separator chamber 93*b* may be formed only by the separator case 93*a*.

An air introduction hole 93*c* is formed in the separator case 93*a*. The air introduction hole 93*c* is formed on a bottom surface of the separator case 93*a* to face the cam chamber 3A. That is, the separator chamber 93*b* of the second oil separator 93 is connected to the cam chamber 3A through the air introduction hole 93*c*. And the new air is introduced into the cam chamber 3A.

After the oil is separated and removed from the blow-by gas in the separator case 92*a* of the first oil separator 92, the blow-by gas is introduced into the intake system through the blow-by gas supply pipe 94. An upstream end of the blow-by gas supply pipe 94 is connected to the PCV valve 92*e*. A downstream end of the blow-by gas supply pipe 94 is connected to a portion of the intake pipe 83, which is located directly downstream of the throttle valve 82. Thus, when the PCV valve 92*e* is opened, the blow-by gas is returned to the intake system for the engine E through the surge tank 81.

One end of the air introduction pipe 95 is connected to a portion of the intake pipe 83, which is located directly upstream of the throttle valve 82. The other end of the air introduction pipe 95 is connected to the separator chamber 93*b* of the second oil separator 93. Outside air (new air), which is used to ventilate the crank chamber 61, is introduced into the separator chamber 93*b* of the second oil separator 93 from the intake system through the air introduction pipe 95.

The air introduction passage 96 is formed to extend in the cylinder head 3 and the cylinder block 1 in the substantially vertical direction. That is, a passage 96*a* formed in the cylinder head 3 and a passage 96*b* formed in the cylinder block 1 are coaxially positioned to extend in the substantially vertical direction so that the passage 96*a* and the passage 96*b* are connected to each other. Thus, the cam chamber 3A is connected to the crank chamber 61 through the air introduction passage 96.

Thus, the new air introduced into the cam chamber 3A from the second oil separator 93 is introduced into the crank chamber 61 through the air introduction passage 96, and the crank chamber 61 is ventilated.

Also, the air introduction passage 96 is used also as an oil return passage. That is, after the oil is separated and removed from the blow-by gas in the first oil separator 92 and delivered downward into the cam chamber 3A, the oil is collected into the oil pan 7 through the air introduction passage 96 using the self weight of the oil. As described later, when the engine E is in a high-speed and high-load state, the oil separated and removed from the blow-by gas in the second oil separator 93 is also collected into the oil pan 7 through the air introduction passage 96.

In the embodiment, the air introduction passage 96 is formed between each pair of adjacent cylinders (because the engine E according to the embodiment includes four cylinders, three air introduction passages 96 are provided). However, the number of the air introduction passages 96 is not limited to three.

For example, the volumes of the oil separators 92 and 93, and the sectional areas of the blow-by gas collection passage 91 and the air introduction passage 96 are appropriately designed to provide blow-by gas collection performance appropriate for the capacity of the engine E, the amount of generated blow-by gas, and the like.

The PCV system 9 according to the embodiment includes a connection portion 98 that functions as a bypass passage for introducing new air. The connection portion 98 is constituted by a wall portion (partition wall) 97 provided in the cylinder head 3, that is, the wall portion 97 that separates the blow-by gas collection passage 91 (91*b*) from the cam chamber 3A. Hereinafter, the connection portion 98 will be described more specifically.

Figure 4A:
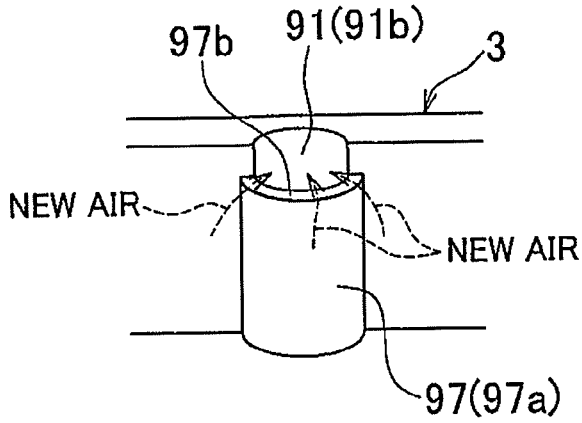
FIG. 4A is a perspective view showing a portion of a cylinder head according to the embodiment, in which a blow-by gas collection passage is formed.
Figure 4B:
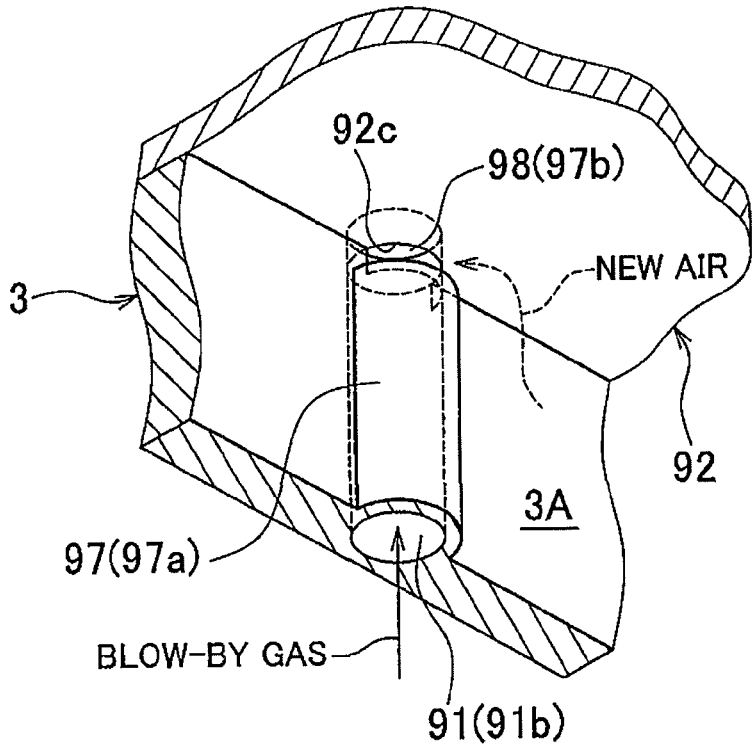
FIG. 4B is a perspective view showing the portion of the cylinder head according to the embodiment, in which the blow-by gas collection passage is formed, when a lower surface of an oil separator contacts the cylinder head.

FIG. 4A is a perspective view showing a portion of the cylinder head 3, in which the blow-by gas collection passage 91 (91*b*) is formed, obliquely seen from above. FIG. 4B is a perspective view showing a contact portion where the upper end surface of the cylinder head 3 contacts the lower surface of the first oil separator 92, seen from the inside of the cam chamber 3A (that is, obliquely seen from below).

Figure 5A:
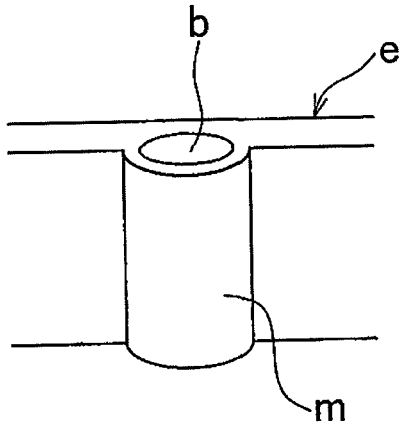
FIG. 5A is a perspective view showing a portion of a cylinder head in related art, in which a blow-by gas collection passage is formed.
Figure 5B:
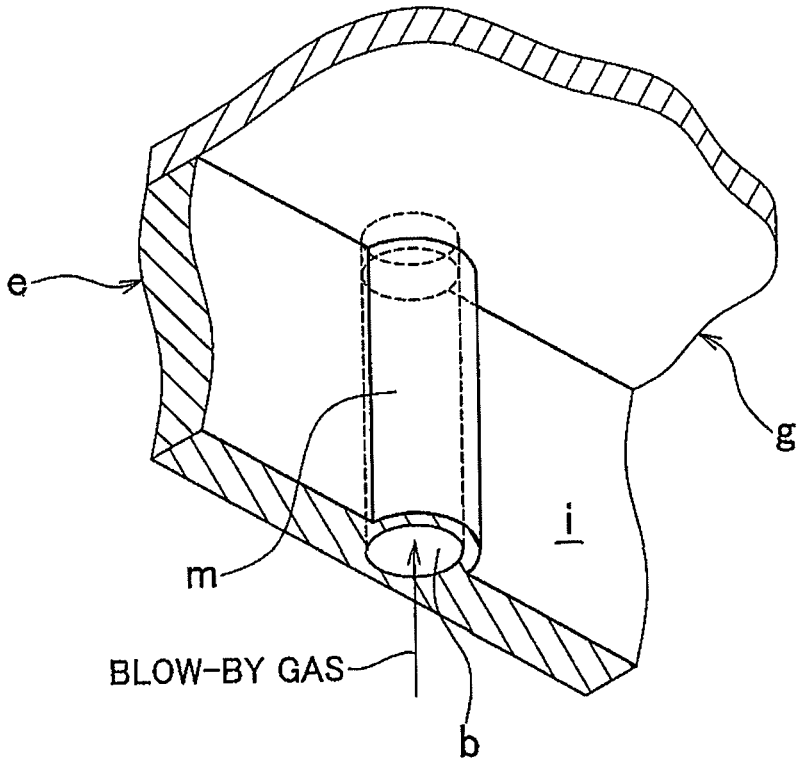
FIG. 5B is a perspective view showing the portion of the cylinder head in the related art, in which the blow-by gas collection passage is formed, when a lower surface of an oil separator contacts the cylinder head.
Figure 10:
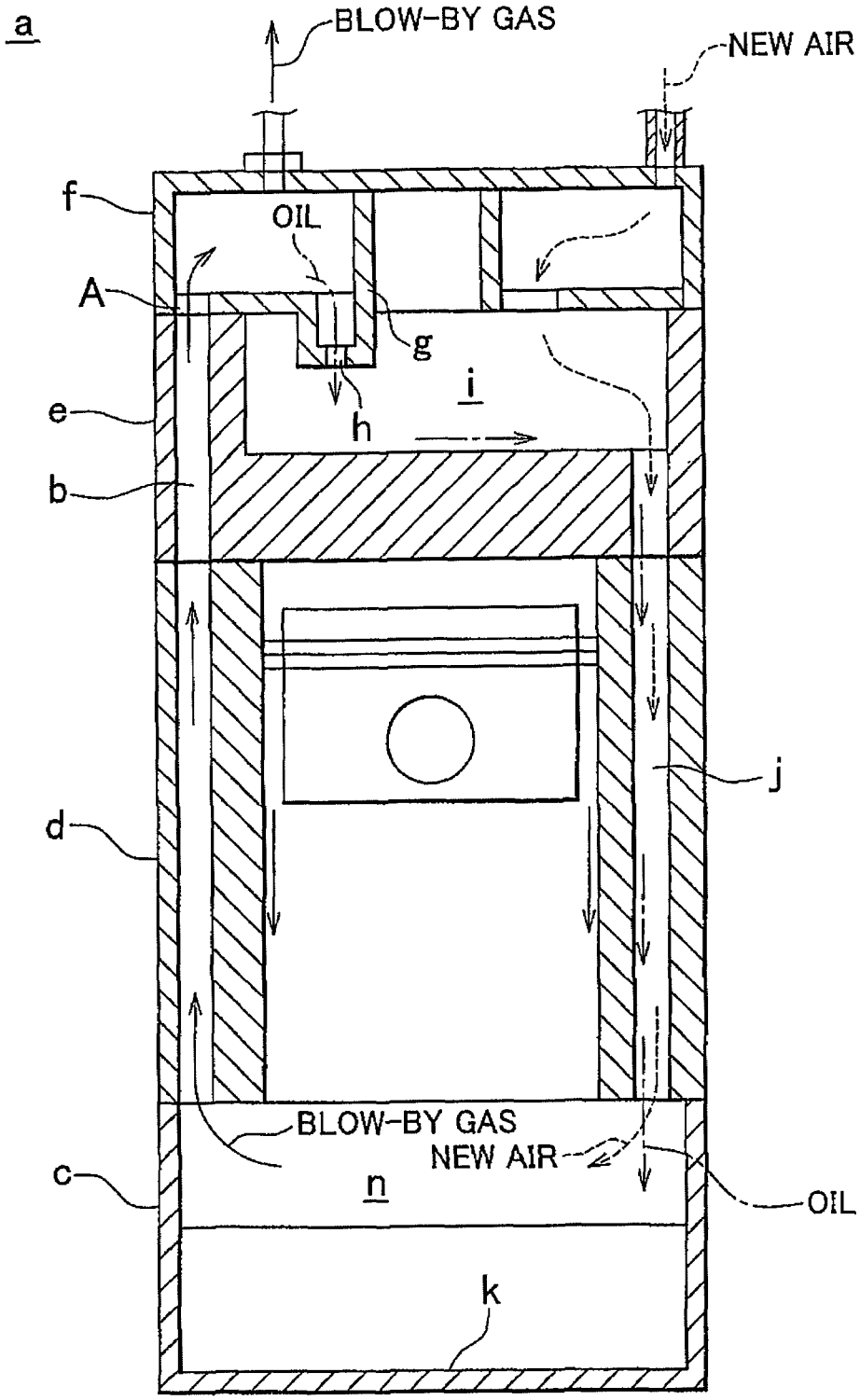
FIG. 10 is a schematic configuration diagram of an engine, which illustrates flows of the blow-by gas, the new air, and the oil in the related art.

FIG. 5A and FIG. 5B show a system in related art (i.e., a system shown in FIG. 10). FIG. 5A is a perspective view showing a portion of a cylinder head "e", in which a blow-by gas collection passage "b" is formed. FIG. 5B is a perspective view showing a contact portion where an upper end surface of the cylinder head "e" contacts a lower surface of an oil separator "g", seen from an inside of a cam chamber "i".

As shown in FIGS. 4A and 4B, in the embodiment, in the cylinder head 3, the wall portion 97 protrudes toward the inside of the cam chamber 3A (i.e., a protruding portion 97*a* is formed) so that the blow-by gas collection passage 91 (91*b*) is formed. The inside of the protruding portion 97*a* functions as the blow-by gas collection passage 91 (91*b*) that extends in the vertical direction.

The position of an upper end of the protruding portion 97*a* is slightly lower than the position of the upper end surface of the cylinder head 3. That is, a portion of the protruding portion 97*a*, which is located near the upper end surface of the cylinder head 3, is cut out (i.e., a cutout portion 97*b* is formed). When the first oil separator 92 contacts the cylinder head 3, a small gap is formed between the cutout portion 97*b* and the lower surface of the first oil separator 92. The small gap is the connection portion 98 that functions as the bypass passage for introducing the new air. Thus, the blow-by gas collection passage 91 (91*b*) is connected to the cam chamber 3A through the connection portion 98.

Therefore, when the blow-by gas is collected, new air introduced from the cam chamber 3A through the connection portion 98 is joined to the blow-by gas that has flown through the blow-by gas collection passage 91 from the crank chamber 61 toward the first oil separator 92 (refer to the dashed line arrows in FIG. 3 and FIG. 4A). That is, the blow-by gas flowing through the blow-by gas introduction hole 92*c* (the inlet of the first oil separator 92) is diluted with the new air flowing from the cam chamber 3A.

The connection area of the connection portion 98 between the cam chamber 3A and the blow-by gas collection passage 91 (i.e., an opening area of the connection portion 98 in a direction orthogonal to the flow line of the new air flowing through the connection portion 98) is set to be smaller than each of the sectional areas of the blow-by gas collection passage 91 and the air introduction passage 96 (for example, the connection area of the connection portion 98 is set to be a half of each of the sectional areas of the blow-by gas collection passage 91 and the air introduction passage 96).

In contrast, in the related art (FIGS. 5A and 5B), there is not a cutout portion in a protruding portion "m" of the cylinder head "e". Therefore, when a lower surface of the oil separator "g" contacts an upper end surface of the cylinder head "e", the blow-by gas collection passage "b" is completely isolated from the cam chamber "i" (i.e., the blow-by gas collection passage "b" is not connected to the cam chamber "i").

[Description of Operation of the PCV System 9]

Next, basic operation of the PCV system 9 with the above-described configuration (i.e., the basic operation when the engine E is operated in a steady state, and the basic operation when the engine E is in a high-speed and high-load state) will be described with reference to FIG. 1 and FIG. 3.

[Operation of the PCV System 9 when the Engine E is Operated in a Steady State, i.e., when the Engine E is not in a High-Speed and High-Load State]

When the engine E is driven, part of intake air (new air) flowing through the intake pipe 83 flows from the air introduction pipe 95 into the second oil separator 93. Then, the new air that has flown into the second oil separator 93 is introduced into the crank chamber 61 through the air introduction passage 96 to ventilate the crank chamber 61.

The blow-by gas, which has blown into the crank chamber 61 through the gap between the cylinder 5 and the piston 51 during the compression stroke and the expansion stroke of the engine E, flows through the blow-by gas collection passage 91 toward the first oil separator 92.

Immediately before the blow-by gas flows into the first oil separator 92 (i.e., at a position immediately upstream of the first oil separator 92), part of the new air in the cam chamber 3A is drawn into the flow of the blow-by gas in the blow-by gas collection passage 91, that is, the new air in the cam chamber 3A flows into the blow-by gas collection passage 91 (91*b*) through the connection portion 98. Thus, the new air is mixed into the blow-by gas that has flown through the blow-by gas collection passage 91. As a result, the blow-by gas is diluted. At this time, the new air is introduced into a relatively large range in the circumferential direction of the blow-by gas collection passage 91 (91*b*) from the cam chamber 3A (refer to the dashed line arrows in FIG. 4A), because the connection portion 98 is a substantially arc-shaped opening in a plane view. Therefore, the blow-by gas is diluted by mixing the new air into the blow-by gas in a relatively large area in the blow-by gas collection passage 91 (91*b*). Accordingly, the entire blow-by gas to be introduced into the first oil separator 92 is uniformly diluted. Also, in this case, the concentration of the blow-by gas in the cam chamber 3A is lower than the concentration of the blow-by gas in the first oil separator 92, and the concentration of the blow-by gas in the first oil separator 92 is lower than the concentration of the blow-by gas in the crank chamber 61.

Because the blow-by gas at the inlet of the first oil separator 92 and inside the first oil separator 92 is the diluted blow-by gas, the generation of sludge is suppressed.

After the blow-by gas is introduced into the separator case 92*a* through the blow-by gas introduction hole 92*c* of the first oil separator 92, the blow-by gas flows in the separator case 92*a* along the longitudinal direction of the separator case 92*a*, while colliding with the baffle plates. Thus, the oil mist is captured due to the so-called inertia collision. As a result, the blow-by gas and the oil mist are separated from each other. Then, the blow-by gas, from which the oil mist has been separated and removed, reaches a downstream end in the separator case 92*a* (one end portion in the longitudinal direction). After the blow-by gas flows out into the blow-by gas supply pipe 94 through the PCV valve 92*e*, the blow-by gas is introduced into the intake pipe 83 (refer to the solid line arrows in FIG. 1). As shown by the chain line arrows in FIG. 3, the oil separated from the blow-by gas is discharged from the oil collection portion 92*d* of the separator case 92*a*, and then, collected into the oil pan 7 through the cam chamber 3A and the air introduction passage 96.

As described above, in the embodiment, immediately before the blow-by gas in the blow-by gas collection passage 91 flows into the first oil separator 92, part of the new air in the cam chamber 3A is introduced into the blow-by gas collection passage 91 (91*b*) through the connection portion 98, and mixed into the blow-by gas to further dilute the blow-by gas. Thus, the blow-by gas collection passage 91 is provided to increase the level of the blow-by gas collection performance, and in addition, the concentration of the blow-by gas is reduced by further diluting the blow-by gas with the new air in the cam chamber 3A at the position immediately upstream of the first oil separator 92, instead of introducing the blow-by gas in the crank chamber 61 into the first oil separator 92 without changing the concentration of the blow-by gas. Accordingly, it is possible to prevent problems caused by the generation of sludge (for example, blockage of a passage for returning oil, and an adverse effect on a valve operating system). Also, because the new air is mixed into the blow-by gas to dilute the blow-by gas at the position immediately upstream of the first oil separator 92, the flow rate of the fluid (mixed fluid of the blow-by gas and the new air) in the blow-by gas collection passage 91 is not increased. Therefore, it is possible to avoid the situation where the flow speed of the fluid in the blow-by gas collection passage 91 is increased, and therefore, the amount of oil mist that flows along with the blow-by gas and flows into the first oil separator 92 is increased.

[Operation of the PCV System 9 when the Engine E is in a High-Speed and High-Load State]

Figure 6:
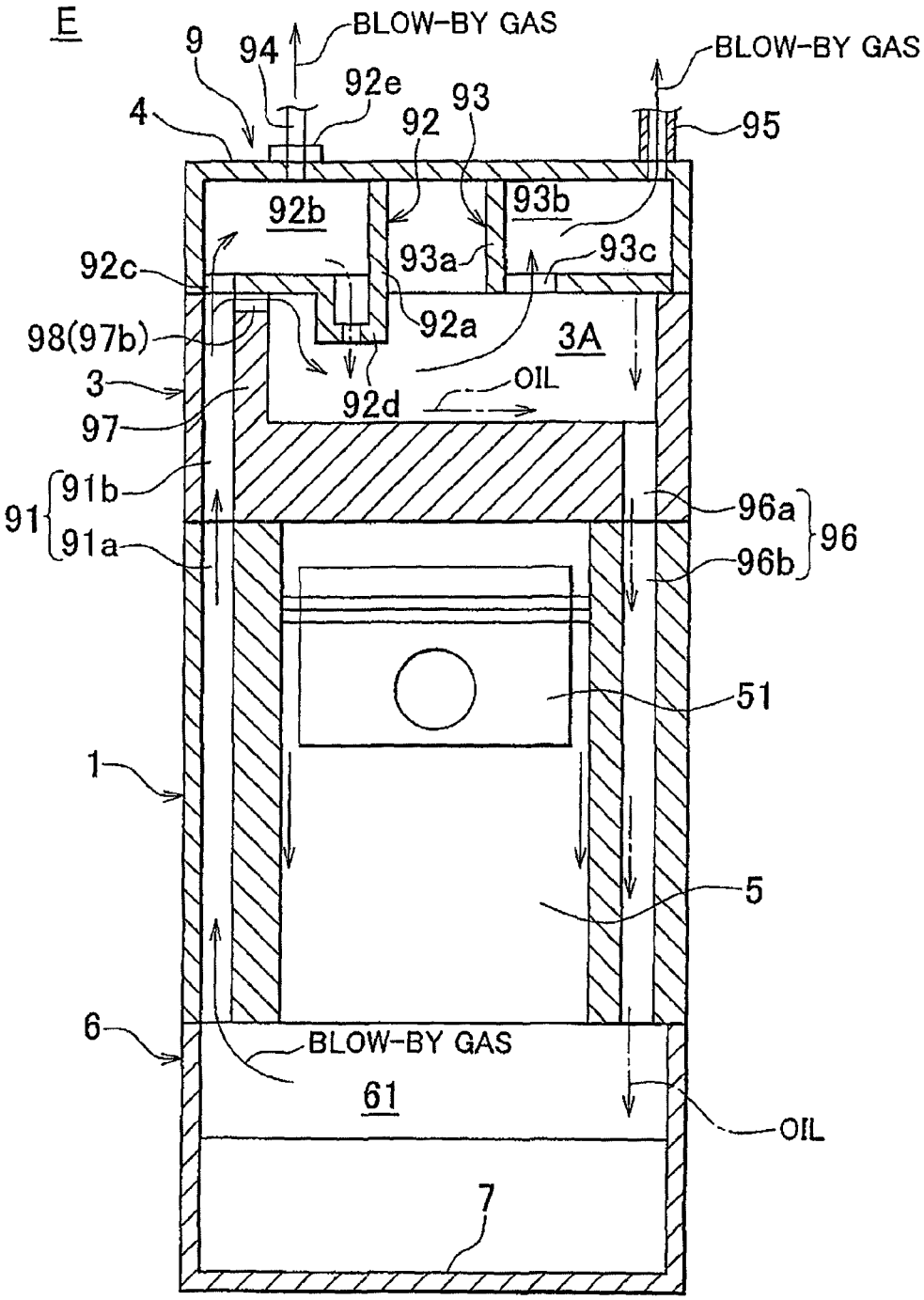
FIG. 6 is a schematic configuration diagram of the engine, which illustrates flows of the blow-by gas and the oil when the engine is operated in a high-speed and high-load state.

Next, a manner in which the blow-by gas and the oil flow when the engine E is in a high-speed and high-load state will be described. FIG. 6 is a schematic diagram of the engine E, which illustrates the manner in which the blow-by gas and the oil flow when the engine E is in a high-speed and high-load state. In FIG. 6, the solid line arrows indicate the flow of the blow-by gas, and the chain line arrows indicated the flow of the oil.

When the engine E is in a high-speed and high-load state, the amount of generated blow-by gas increases. In this case, the blow-by gas flows from the crank chamber 61 into the blow-by gas collection passage 91, and then part of the blow-by gas flows into the first oil separator 92. Then, after the oil is separated and removed from the part of the blow-by gas by the same operation as the above-described operation in the first oil separator 92, the part of the blow-by gas is returned to the intake pipe 83 for the engine E.

The rest of the blow-by gas, which does not flow into the first oil separator 92, flows into the cam chamber 3A through the connection portion 98. That is, the blow-by gas flows through the connection portion 98 in a direction opposite to the above-described direction of the flow of new air (i.e., the flow of new air when the engine E is in a steady state). Then, the blow-by gas flows from the cam chamber 3A into the second oil separator 93. After the oil is separated and removed from the blow-by gas in the second oil separator 93, the blow-by gas is returned to the intake pipe 83 for the engine E. The oil separation operation is performed in the second oil separator 93 in the same manner as the manner in which the oil separation operation is performed in the first oil separator 92. The oil separated from the blow-by gas in the second oil separator 93 flows downward into the cam chamber 3A through an oil discharge hole (not shown), and then, the oil is collected into the oil pan 7 through the air introduction passage 96.

In the PCV system that includes the blow-by gas collection passage "b" in the related art (refer to FIG. 10), when the engine is in a high-speed and high-load state, a relatively large amount of blow-by gas in a crankcase "n" flows into an oil return passage "j", as well as into the blow-by gas collection passage "b". Thus, the blow-by gas flows through the oil return passage "j" in a direction opposite to the direction in which the oil flows downward. Accordingly, the flow of the blow-by gas interferes with the downward flow of the oil in the oil return passage "j", and therefore, this oil collection operation cannot be performed smoothly. As a result, a large amount of liquid oil is accumulated in the cam chamber "i" and the oil separator "g". Thus, this liquid oil may be delivered into the intake system for the engine, along with the blow-by gas.

In the embodiment, by using the connection portion 98 as a part of the blow-by gas collection passage, it is possible to prevent backflow of the blow-by gas (i.e., the flow of the blow-by gas in the direction opposite to the direction of the downward flow of the oil) in the air introduction passage 96. Thus, even when the engine E is in a high-speed and high-load state, good oil collection performance is provided.

As described above, in the embodiment, when the engine E is in a high-speed and high-load state, the second oil separator 93 performs a gas handling function, and the connection portion 98 is used as the passage through which the blow-by gas flows toward the second oil separator 93. Therefore, it is possible to increase the level of the gas handling performance of the PCV system 9, while effectively using the connection portion 98.

[Result of Simulation]

Next, the result of simulation performed to confirm the advantageous effect obtained in the above-described embodiment will be described. In the simulation, the concentration of NOx at the inlet portion (lower end portion) of the blow-by gas collection passage 91, and the concentration of NOx near the blow-by gas introduction hole 92*c* (inlet) of the first oil separator 92 are calculated using CAE (Computer Aided Engineering), while changing the ratio of the opening area of the connection portion 98 (the cross sectional area of the bypass passage) to the cross sectional area of the blow-by gas collection passage 91 in a range of 0 to 0.5.

Figure 7:
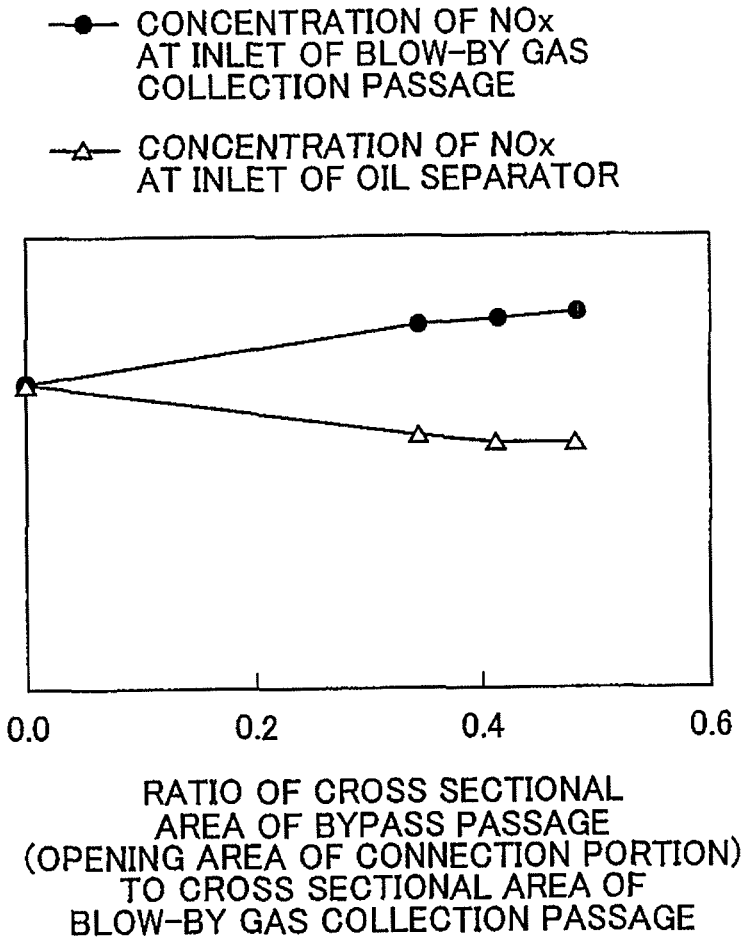
FIG. 7 is a diagram showing a result of simulation performed to confirm advantageous effects obtain in the embodiment.

FIG. 7 shows the result of the simulation. As shown in FIG. 7, as the ratio of the opening area of the connection portion 98 (the cross sectional area of the bypass passage) to the cross sectional area of the blow-by gas collection passage 91 increases, the concentration of NOx at the inlet portion of the blow-by gas collection passage 91 gradually increases, and the concentration of NOx near the blow-by gas introduction hole 92*c* gradually decreases. Thus, it is confirmed that the blow-by gas at the inlet of the first oil separator 92 and inside the first oil separator 92 is the blow-by gas diluted due to the effect of the connection portion 98.

Modified Example

Next, modified examples of the invention will be described. In each of the modified examples described below, the shape of the cutout portion 97*b*, which is formed by cutting out a portion of the protruding portion 97*a* to form the connection portion 98, is different from the shape of the cutout portion 97*b* in the above-described embodiment. The other portions of the configuration are the same as those in the above-described embodiment. Therefore, only the shape of the cutout portion 97*b* will be described.

Figure 8A:
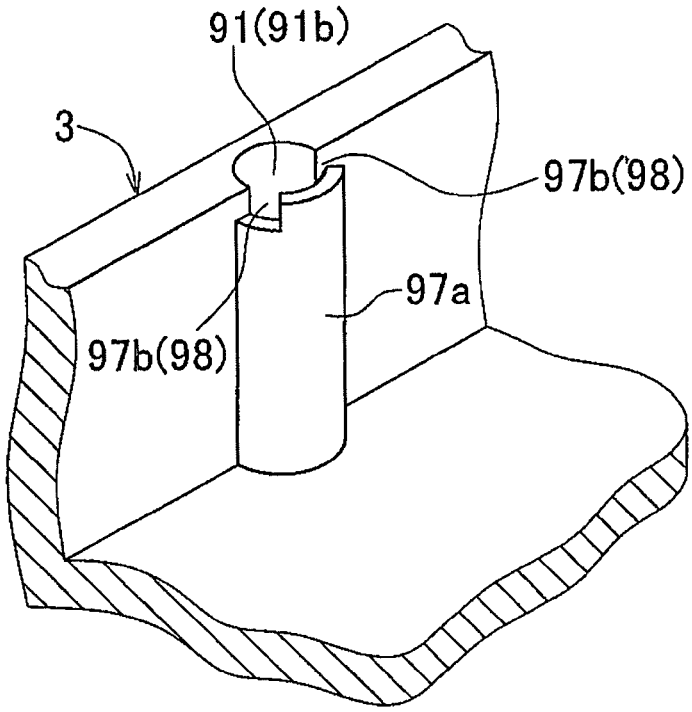
FIGS. 8A and 8B show a first modified example.
Figure 8B:
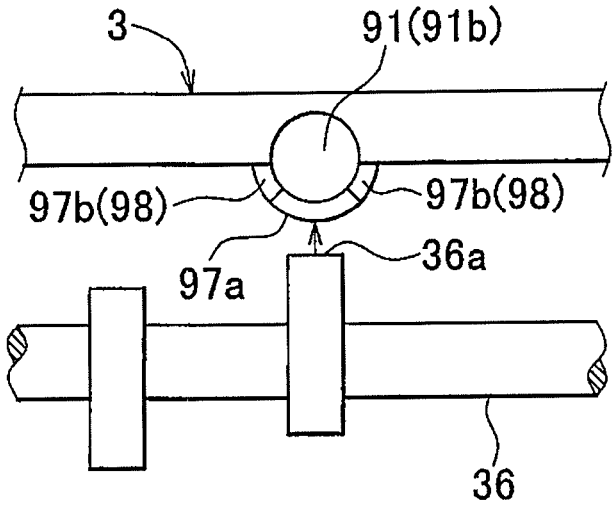
Figure 9A:
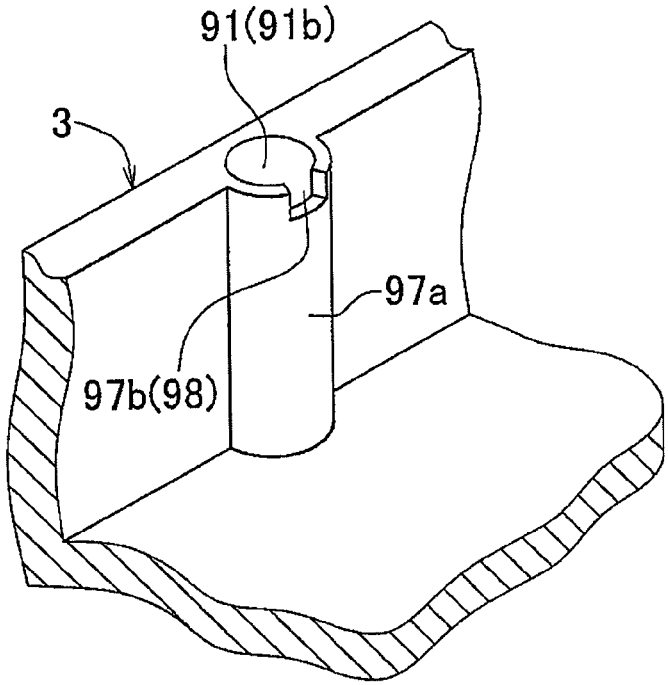
FIGS. 9A and 9B show a second modified example.
Figure 9B:
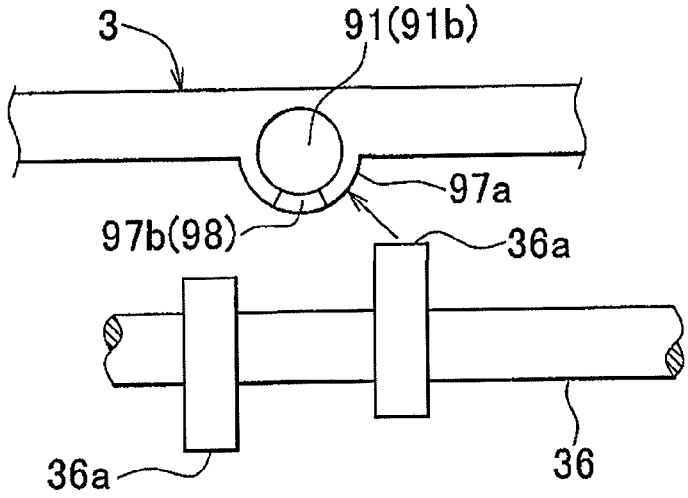

FIGS. 8A and 8B show a first modified example. FIGS. 9A and 9B show a second modified example. Each of FIG. 8A and FIG. 9A is a perspective view showing a portion of the cylinder head 3, in which the blow-by gas collection passage 91 (91*b*) is formed. Each of FIG. 8B and FIG. 9B is a plane view showing the same portion of the cylinder head 3, and the camshaft 36.

In each of the modified examples, the cutout portion 97*b* is formed so that the oil splashed from a cam nose 36*a* due to the rotation of the camshaft 36 does not enter the blow-by gas collection passage 91 (91*b*).

More specifically, in the first modified example (FIG. 8), a direction in which the protruding portion 97*a* faces the cam nose 36*a* of the camshaft 36 is orthogonal to a direction in which the camshaft 36 extends. Therefore, in the protruding portion 97*a*, only both end portions in the circumferential direction, that is, only the portions that do not face the cam nose 36*a* are cut out, and the connection portions 98, 98 are formed in the both end portions in the circumferential direction.

In the second modified example (FIG. 9), the direction in which the protruding portion 97*a* faces each cam nose 36*a* of the camshaft 36 is not orthogonal to the direction in which the camshaft 36 extends, and there is a predetermined angle between the direction in which the protruding portion 97*a* faces each cam nose 36*a* of the camshaft 36, and the direction in which the camshaft 36 extends. Therefore, in the protruding portion 97*a*, both end portions in the circumferential direction, that is, the portions that face the respective cam noses 36*a* are not cut out. Only the other portion, that is, only a center portion in the circumferential direction is cut out, and the connection portion 98 is formed in the center portion in the circumferential direction.

In this configuration, it is possible to avoid the situation where the oil splashed from the cam nose 36*a* due to the rotation of the camshaft 36 enters the blow-by gas collection passage 91 (91*b*). In each of FIG. 8B and FIG. 9B, the arrow indicates a direction in which the oil is splashed from the cam nose 36*a* toward the protruding portion 97*a*.

In this configuration, it is possible to avoid the situation where a large amount of oil flows into the first oil separator 92, and to suppress the amount of oil introduced into the first oil separator 92. Also, it is possible to smoothly introduce the new air into the blow-by gas collection passage 91 (91*b*).

Other Embodiments

In each of the above-described embodiment and modified examples, the invention is applied to a port-injection type gasoline engine with four cylinders provided in a vehicle. However, the invention need not necessarily be applied to the engine for a vehicle. The invention may be applied to engines used for other purposes. Also, the number of cylinders is not limited to a specific number, and the type of engine is not limited to a specific type (for example, an inline engine, a V-type engine, and a horizontal opposed engine).

The connection portion 98 is provided by providing the protruding portion 97*a* in the cylinder 3, cutting out the upper end portion of the protruding portion 97*a*, and disposing the first oil separator 92 so that the lower surface of the first oil separator 92 contacts the upper end surface of the cylinder head 3. However, the invention is not limited to this configuration of the connection portion 98. The connection portion 98 may be provided by forming a circular or rectangular through-hole in the wall portion 97 of the cylinder head 3.

In each of the above-described embodiment and modified examples, the PCV system 9 includes the two oil separators, that is, the first and second oil separators 92 and 93. However, the invention may be applied to a PCV system 9 that includes only the first oil separator 92.

The invention claimed is:

1. A positive crankcase ventilation system provided in an internal combustion engine, comprising:

an air introduction passage through which new air present in an inner space of a cylinder head is introduced into a crankcase from the inner space of the cylinder head;

a blow-by gas collection passage through which a first breather chamber provided in an upper portion of a cylinder is connected to an inside of the crankcase, wherein:

blow-by gas in the crankcase is delivered to an intake system through the blow-by gas collection passage and the first breather chamber;

the blow-by gas collection passage is formed by a partition that separates the blow-by gas collection passage from the inner space of the cylinder head; and a connection portion, through which the inner space of the cylinder head is connected to the blow-by gas collection passage, is provided in the partition wall, wherein:

the first breather chamber formed by a breather case attached to a head cover provided on the cylinder head; and the connection portion is defined by an upper surface of an upper end portion of the partition wall and a lower surface of the breather case.

2. The positive crankcase ventilation system according to claim 1, wherein:

the partition wall includes a protruding portion that protrudes toward the inner space of the cylinder head;

an inside of the protruding portion functions as the blow-by gas collection passage;

an upper end of the protruding portion is disposed at a position lower than an upper end portion of the cylinder head by forming the cutout portion; and the connection portion is a gap between the upper end of the protruding portion and the lower surface of the breather case when the lower surface of the breather case contacts an upper end surface of the cylinder head.

3. The positive crankcase ventilation system according to claim 1, wherein the cutout portion is formed in the upper end portion of the partition wall so that the cutout portion does not face a cam nose.

4. The positive crankcase ventilation system according to claim 1, wherein:

a part of the upper end portion of the partition wall has a cutout portion, which defines a gap between the upper end portion of the partition wall and the lower surface of the breather case thereby defining the connection portion.

5. The positive crankcase ventilation system according to claim 1, wherein:

the blow-by gas flown through the blow-by gas collection passage towards the first breather chamber is diluted with the new air flown into the blow-by gas collection passage from the inner space of the cylinder head through the connection portion.

6. The positive crankcase ventilation system according to claim 1, further comprising an oil collection portion protruding from the bottom surface of the breather case, wherein a bottom surface of the oil collection portion includes an opening which opens into a cam chamber.

* * * * *